US006428101B1

(12) United States Patent
Bernstein

(10) Patent No.: US 6,428,101 B1
(45) Date of Patent: Aug. 6, 2002

(54) SUSPENDED FURNITURE APPARATUS

(76) Inventor: Robert Bernstein, 1360 N. Sandburg Ter., Suite 2109, Chicago, IL (US) 60610

( * ) Notice: Subject to any disclaimer, the term of this patent is extended or adjusted under 35 U.S.C. 154(b) by 0 days.

(21) Appl. No.: 09/571,782

(22) Filed: May 16, 2000

(51) Int. Cl.[7] ..... A47C 15/00
(52) U.S. Cl. ..... 297/273; 108/48; 297/277
(58) Field of Search ..... 297/273, 276, 297/277, 278; 108/42, 48; 182/150, 187; 248/317, 611

(56) References Cited

U.S. PATENT DOCUMENTS

| | | | | | |
|---|---|---|---|---|---|
| 275,899 | A | * | 4/1883 | Forster | 297/276 |
| 743,546 | A | * | 11/1903 | Nix | 297/273 |
| 3,181,828 | A | | 5/1965 | Cramer | |
| 4,424,760 | A | | 1/1984 | Grutman | |
| 5,176,266 | A | * | 1/1993 | Gillet | 108/106 |
| 5,205,375 | A | * | 4/1993 | Shriver | 108/152 |
| 5,374,107 | A | | 12/1994 | Schnitzler | |
| 5,511,258 | A | * | 4/1996 | Barr, Sr. | 297/273 |
| 5,788,327 | A | | 8/1998 | Gregory | |

* cited by examiner

*Primary Examiner*—Peter R. Brown
(74) *Attorney, Agent, or Firm*—Mark E. Wiemelt

(57) ABSTRACT

The present invention is for a suspended furniture apparatus 10 for use as a table or a chair. The novel furniture apparatus 10 comprises a generally horizontal and substantially planar surface 12 having a front portion 18, a rear portion 20, a left side 24, a right side 22 and edges 26*a*–26*d* thereabout; and means 14 for suspending the planar surface 12 in a stationary position, wherein the suspending means 14 is secured to the planar surface 12. The suspending means 14 is fixed at a point 30 above and at least one point 32 below the planar surface 12. The planar surface 12 is suspended solely by suspending means 14 which are in tension.

27 Claims, 9 Drawing Sheets

44
30
80b
80b
14
10
68a
68c
38
68c
68a
80c
80b
28d
26d
22
20
74
72
28c
70
12
28a
12a
78a
80b
76
78a
78b
80c
26b
24
26a
18
78b
68e
68e
68d
28b
50
58
68b
46
68b
40
80b
54
64
32
62
68d
80b
80a
56
42
60
32
36

44
10
38
52
50
12a
26c
26a
26b
46
42
64
54
40
92
92

80b
68c
68a
10
108
98
94
108
102
96
16
100
38
A
12a
80a
80c
26c
26b
68e
80a
68d
40
80a
42

SUSPENDED FURNITURE APPARATUS

FIELD OF THE INVENTION

This invention is directed to suspended furniture. In particular, this invention is directed to furniture suspended by cables whereby the furniture apparatus does not move when weight is applied thereon. This invention is also directed to furniture which is suspended solely by cables in tension.

BACKGROUND OF THE INVENTION

Suspended furniture for use both indoors and outdoors is known in the art. However, such furniture is usually pivoted and movable in a swing-like manner. Exemplary suspended chairs of this type are disclosed in U.S. Pat. Nos. 5,788,327; 5,374,107; 4,424,760; and 3,181,828. One disadvantage to the swinging furniture is that a person sitting on a swinging suspended chair, for example, would have a difficult time attempting to eat a meal or consume a beverage. This limits the mainer in which the suspended chairs may be utilized. For instance, it would not be practical to use existing suspended chairs at the dining table in a person's house.

BRIEF SUMMARY OF THE INVENTION

The present invention is for a suspended furniture apparatus 10 for use as a table or a chair. The novel furniture apparatus 10 comprises a generally horizontal and substantially planar surface 12 and non-rigid means 14 for suspending the planar surface 12 in a stationary position. The planar surface 12 has a front portion 18, a rear portion 20, a left side 24, a right side 22 and edges 26 thereabout. The suspending means 14 is secured to the planar surface 12 and fixed at a point 30 above and at least one point 32 below the planar surface 12. The preferred suspending means 14 comprises cables 68 attached to cable connector members 78 which, in turn, are secured to the planar surface 12 and the fixed points 30,32. Turnbuckles 72 may be used as tensioning means 70 to adjust the tension of the cables 68, thereby maintaining the stationary position of the novel furniture apparatus 10. It should be readily apparent to those skilled in the art that non-rigid means such as ropes, chains, wires, cords, twine and the like may be used.

Another embodiment of the present invention comprises securing a backrest portion 16 above the planar surface 12, so that the novel furniture apparatus 10 may be used as a stationary chair. The planar surface 12 and the backrest portion 16 are preferably in quadrilateral shapes.

A further embodiment of the novel invention comprises utilizing a three-piece frame 36 for securing the fixed points 30,32 of the suspended furniture apparatus 10. The preferred three-piece frame 36 comprises a vertical column 38, a horizontal beam 40, and a horizontal bar 42.

It is, therefore, an object of the present invention to teach a suspended furniture apparatus that is stationary.

Another object of the instant invention is to teach a suspended furniture apparatus that may be used as a table or a chair.

A further object of the present invention is to teach a suspended furniture apparatus that may be used indoors and outdoors.

Another object of the present invention is to teach a suspended furniture apparatus that may be used with or without a backrest portion.

Another object of the present invention is to teach a suspended furniture apparatus that is suspended by cables to a frame.

It is another object of the instant invention to teach a suspended furniture apparatus that is suspended by cables to the ceiling or wall and the ground.

Still a further object of the present invention is to teach a suspended furniture apparatus that is suspended solely by cables in tension.

Other objects, features and advantages of the present invention will become readily apparent from the following detailed description and accompanying drawings.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

DETAILED DESCRIPTION OF THE INVENTION

Figure 1:
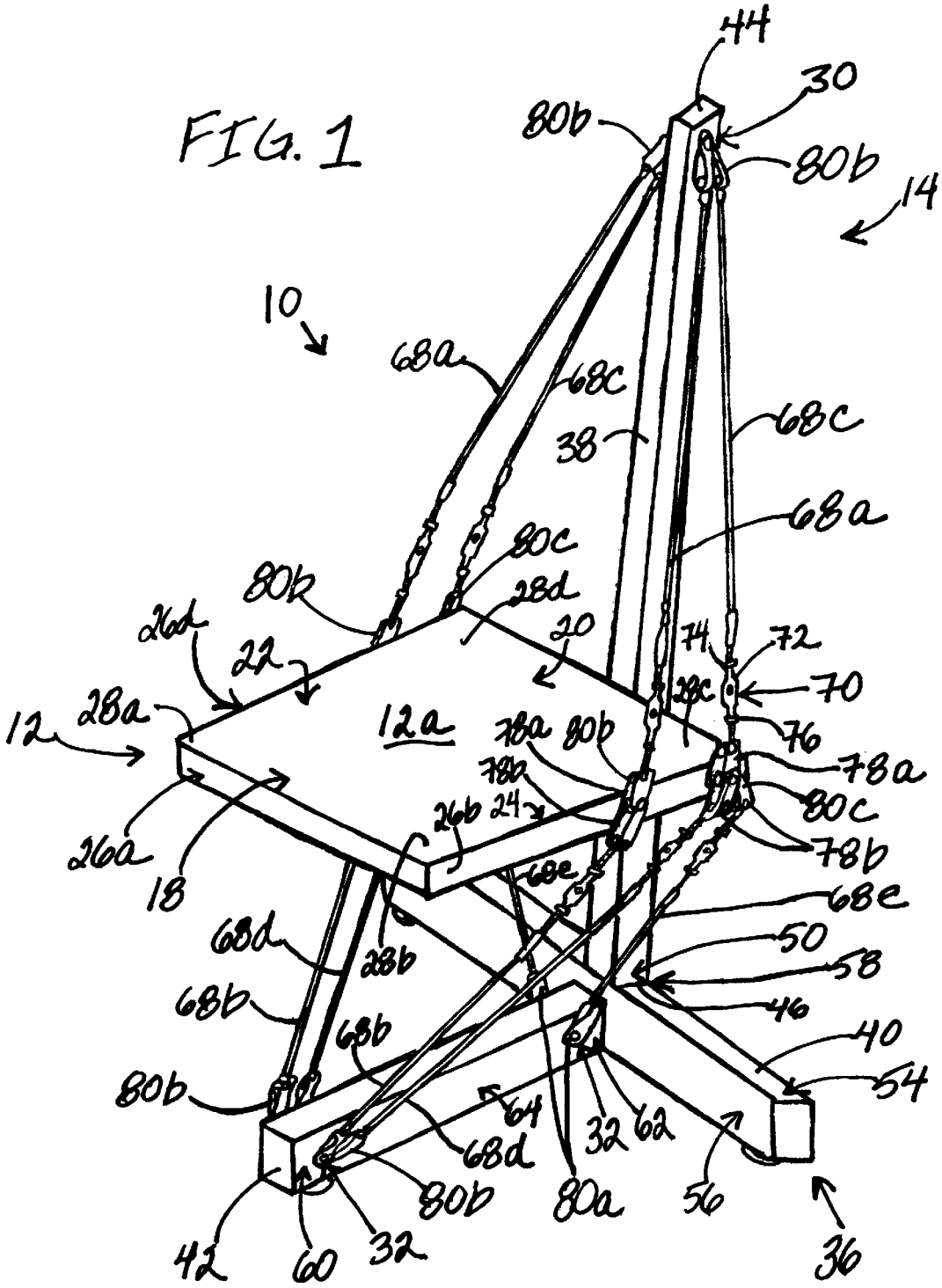
FIG. 1 illustrates an elevational perspective view of a first embodiment of the novel furniture apparatus 10.
Figure 3:
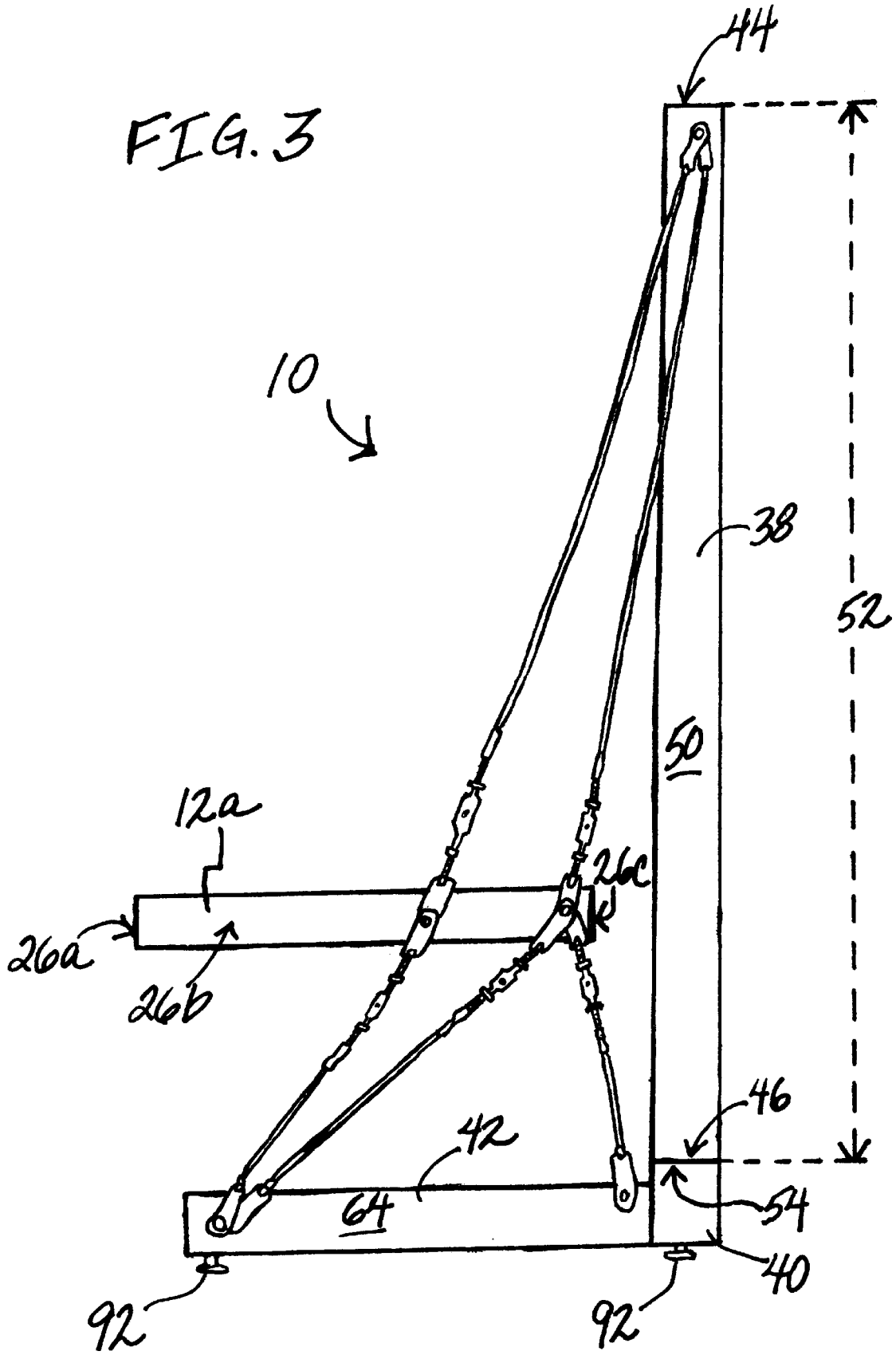
FIG. 3 shows a side view of a first embodiment of the furniture apparatus 10 of the instant invention.
Figure 4:
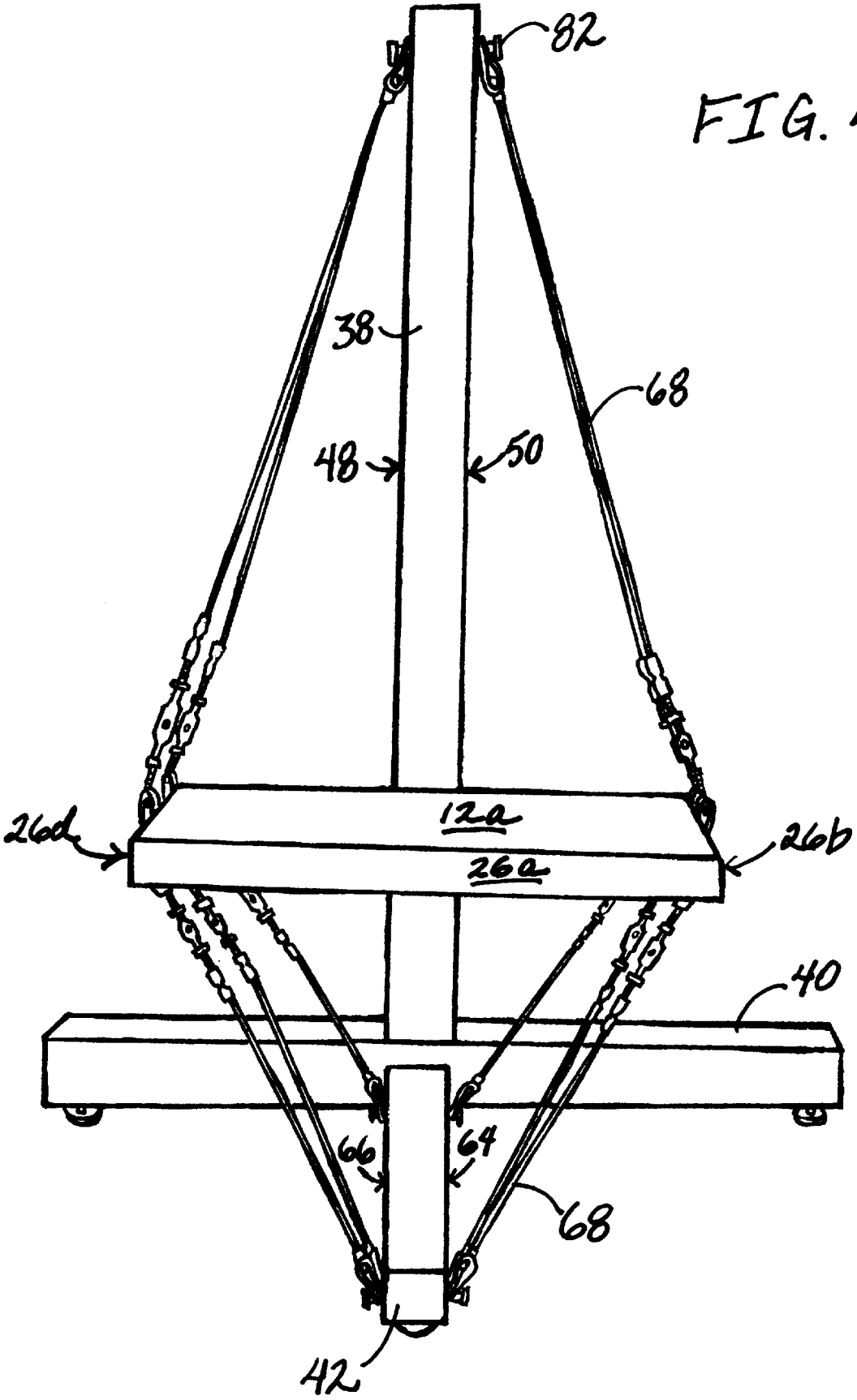
FIG. 4 illustrates a frontal view of a first embodiment of the novel furniture apparatus 10.
Figure 5:
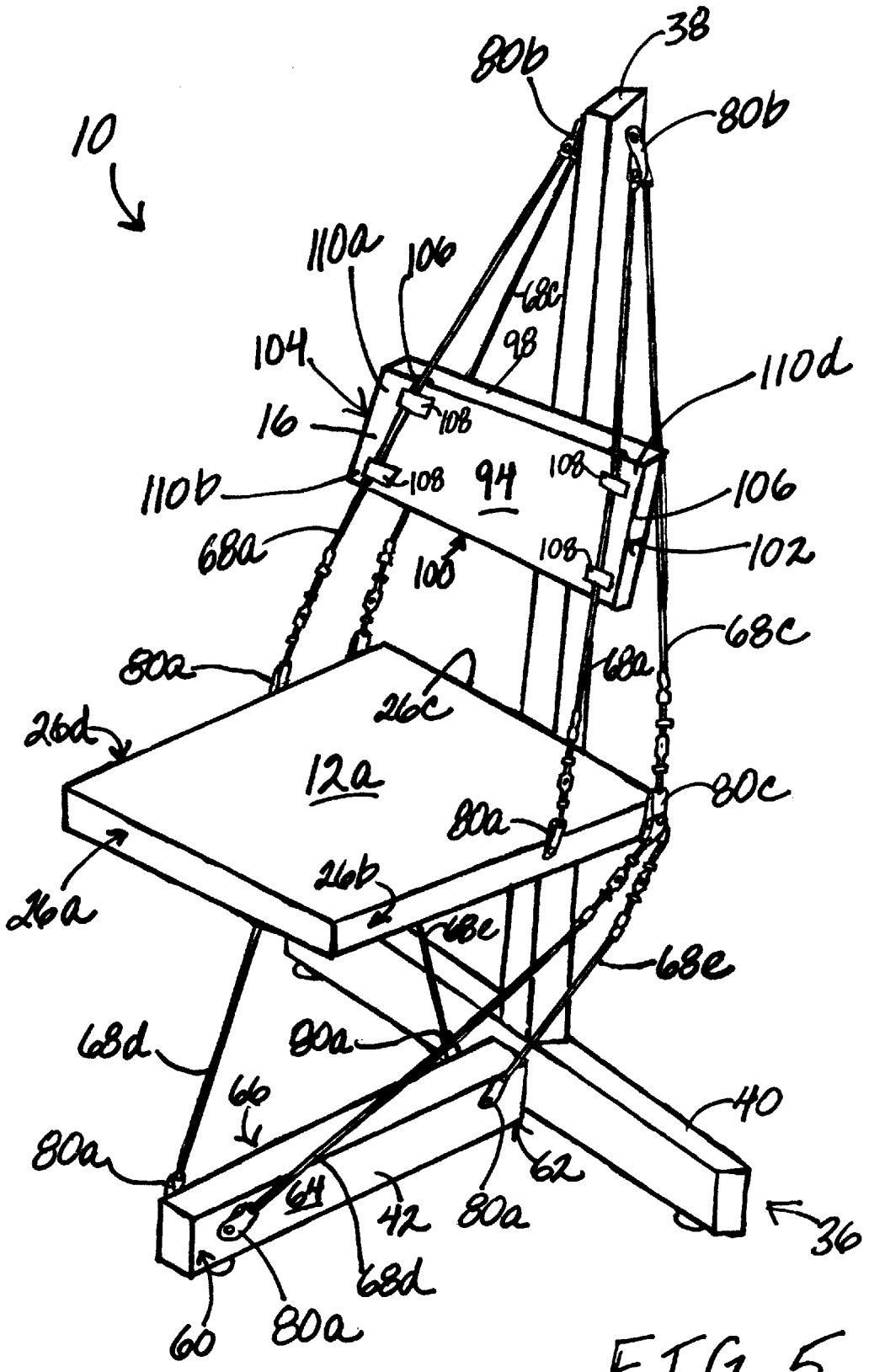
FIG. 5 displays a perspective view of a second embodiment of the novel furniture apparatus 10.
Figure 6:
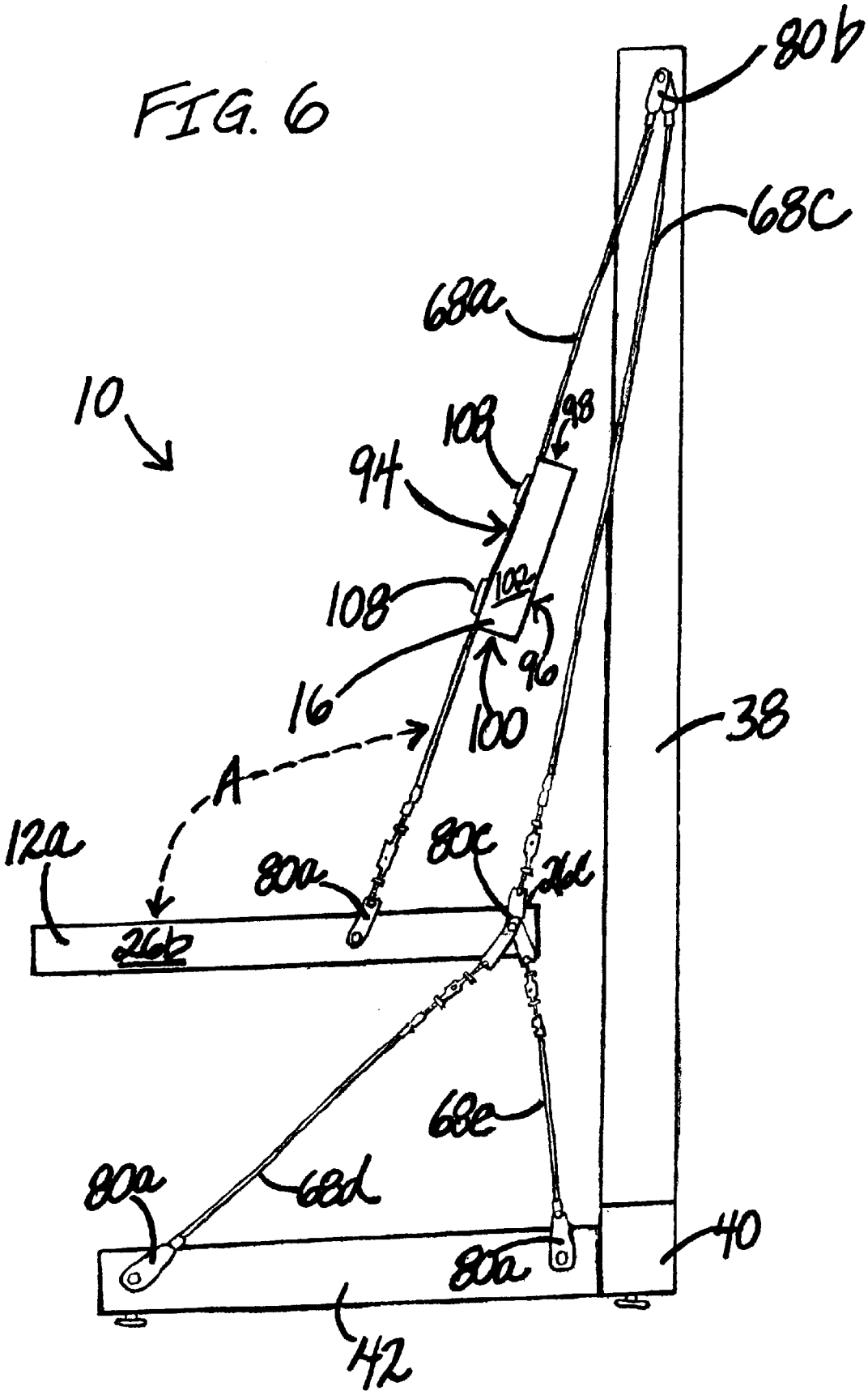
FIG. 6 illustrates a side view of the second embodiment of the novel furniture apparatus 10.
Figure 7:
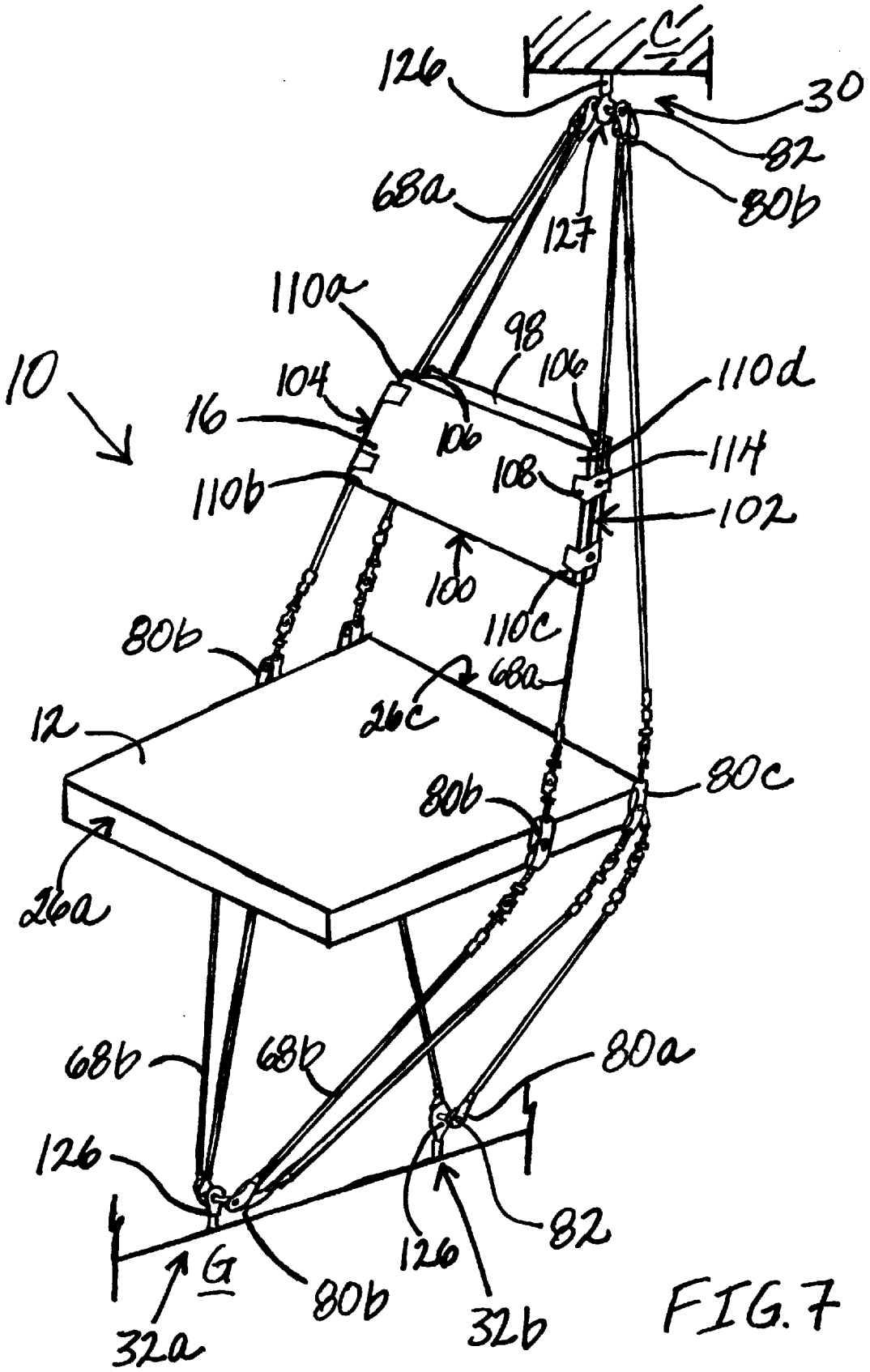
FIG. 7 shows a perspective view of a third embodiment of the furniture apparatus 10 of the instant invention.
Figure 8:
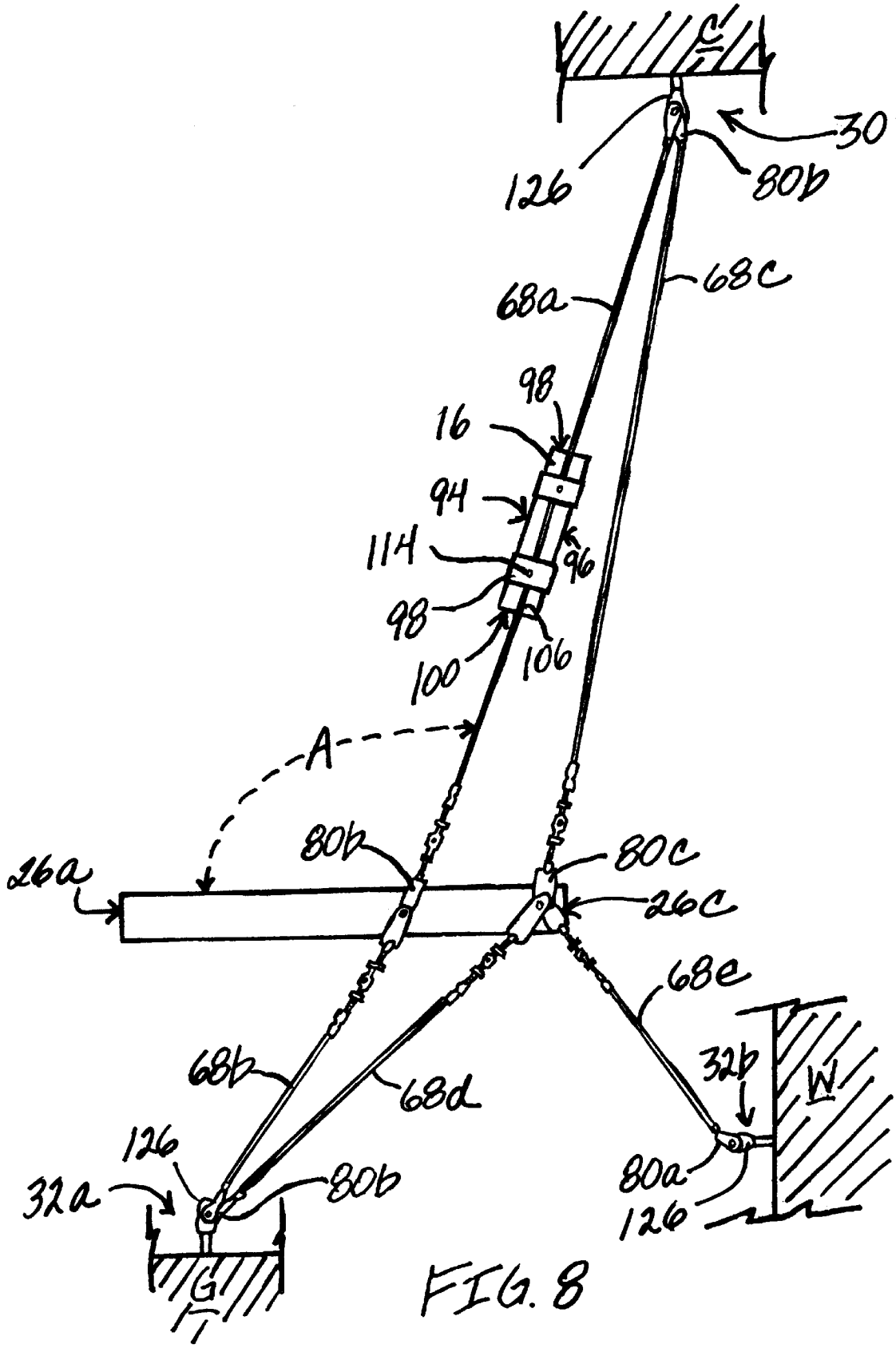
FIG. 8 illustrates a side view of the third embodiment of the novel furniture apparatus 10.
Figure 9:
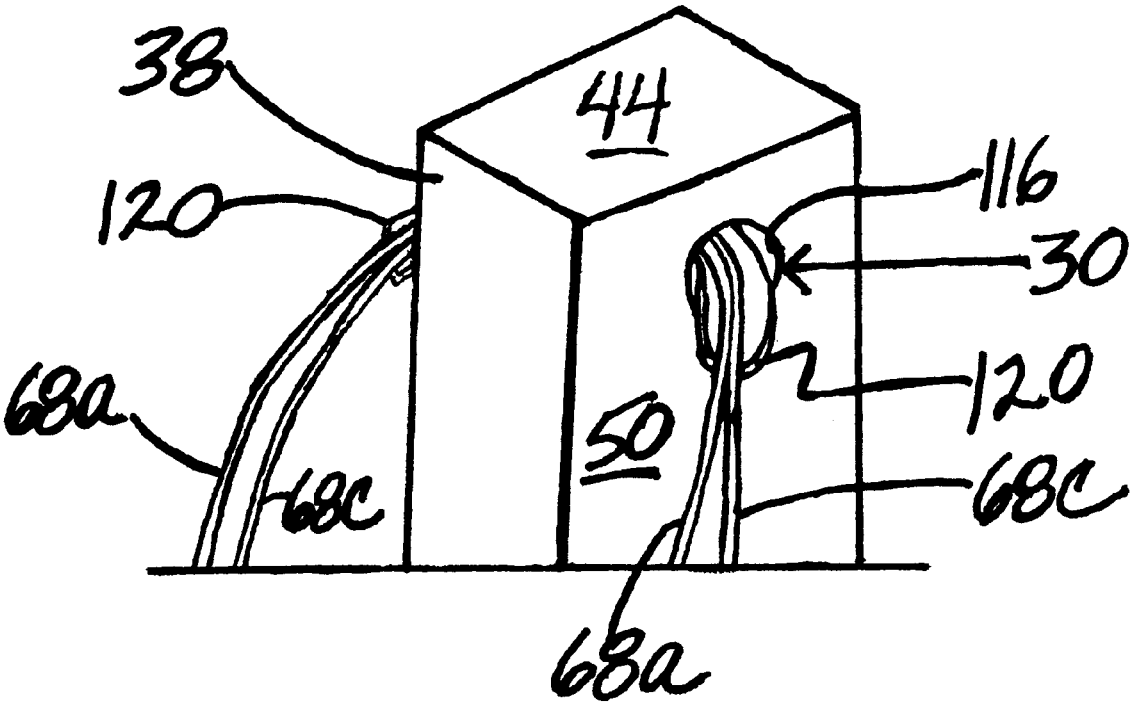
FIG. 9 displays an enlarged perspective view of a fixed point 30 of the suspending means 14 of the novel furniture apparatus 10.

Referring to the drawings, the present invention is directed to a novel suspended furniture apparatus 10 that may be used as a chair or a table. FIGS. 1, 3–4 illustrate one embodiment of the invention whereby the suspended furniture apparatus 10 is shown with a generally horizontal and substantially planar surface 12 and means 14 for suspending the planar surface 12 in a stationary position. Alternatively, FIGS. 5–6 illustrate another embodiment of the invention whereby the suspended furniture apparatus 10 is shown with one embodiment of a backrest portion 16. FIG. 7 shows a second embodiment of the backrest portion 16 with the suspending means 14 being fixed to the ceiling C and the ground G. FIG. 8 illustrates a variation of the embodiment shown in FIG. 7 in that the suspending means 14 is fixed to the ceiling C, wall W, and ground G. And, FIG. 9 illustrates another embodiment for securing the suspending means 14 at a fixed point 30.

Referring to FIG. 1, the suspended furniture apparatus 10 is shown in an elevational perspective view. The planar surface 12 preferably has a front portion 18, a rear portion 20, right 22 and left 24 sides, and an edge 26 therearound. The edges 26 of the planar surface 12 are numbered from 26*a*–26*d* for easier reference thereto. The planar surface 12 most preferably comprises a square-shaped planar surface 12*a* having four corners 28*a*–28*d*. The planar surface 12 may also have other quadrilateral shapes, such as rectangular or trapezoidal shapes. The planar surface 12 may be made of a wood block, a sheet of metal, such as aluminum, polymer or composite materials, steel or glass. This planar surface 12 may be used as either a tabletop or a seat of a chair.

The suspending means 14 is secured to the planar surface 12 so that the planar surface 12 is held or suspended in a stationary position. Preferably, the suspending means 14 is fixed at a point 30 above the planar surface 12 and at least another point 32 below the planar surface 12. FIG. 1 shows two fixed points 32 below the planar surface 12*a*. While the fixed points 30,32 may be fixed to the ceiling C, the wall W or the ground G (shown in FIGS. 7–8), the preferred fixed points 30,32 are secured to a frame 34. The most preferred frame 34 comprises a three-piece frame 36. This frame 36 may be varied in its dimensions and design depending upon the number of fixed points 30,32 and the size of the desired furniture apparatus 10.

The three-piece frame 36 preferably comprises a vertical column 38, a horizontal beam 40 and a horizontal bar 42. The column 38 has top 44 and bottom 46 edges, right 48 (shown in FIG. 4) and left 50 sides, and a length 52 (shown in FIG. 3) that extends above and below the planar surface 12*a*. The beam 40 has a top edge 54, a frontal side 56 and a midpoint 58, and it lies on a ground surface (not shown) in a parallel fashion to the rear edge 26*c* (shown in FIG. 3) of the planar surface 12*a*. Attached vertically onto the midpoint 58 of the top edge 54 of the beam 40 is the bottom edge 46 of the column 38. It is preferred that this attachment be perpendicular to the edge 54 of the beam 40. The bar 42 has front 60 and back 62 ends, and left 64 and right 66 (shown in FIG. 4) sides. Attached horizontally to the midpoint 58 of the frontal side 56 of the beam 40 is the back end 62 of the horizontal bar 42. It is also preferred that this attachment be perpendicular to the frontal side 56 of the beam 40. The three-piece frame 36 should be made of strong substances, such as steel, iron polymer of composite materials. The column 38, beam 40, and bar 42 of the three-piece frame 36 are preferably attached in the above-described manner using welding techniques known in the art, although it should be readily understood by one skilled in the art that a variety of frames and attachment means could be utilized without deviating from the spirit of the invention. One of skill in the art would also understand that stabilizing means 43 (not shown) may be attached below the front end 60 of the horizontal bar 42 in a perpendicular manner thereto to provide stability to the frame 36. Preferred stabilizing means 43 are stabilizing crossbars 43*a*.

The suspending means 14 preferably comprises cables 68 attached to the three-piece frame 36 and secured to the planar surface 12*a*. The preferred cables 68 comprise steel cables 68*a*. The most preferred steel cables 68*a* comprise 7×7–3/32 inch diameter stainless steel cables manufactured by Loos & Company, Inc. To ensure that the planar surface 12*a* is stationary when suspended, there must be tension on the cables 68. To apply tension to the cables 68, tensioning means 70 are used to prevent the cables 68 from loosening, which would result in the undesirable swaying or swinging of the planar surface 12*a*. The tensioning means 70 should be adjustable so that the tension of the cables 68 may be modified as needed. The most preferred tensioning means 70 comprises turnbuckles 72 having opposing longitudinal ends 74,76, whereby one end 74 is securely fastened to a cable 68 and the opposing end 76 is secured to one prong 78 of a cable connector member 80. Each turnbuckle 72 is rotatable perpendicular to its longitudinal axis for adjusting its tension. The connection between the cables 68 and each connector member 80 and turnbuckle 72 attached thereto is preferably accomplished using swaging, which is known to one of skill in the art. The swaging technique produces a connection that has the same tensile strength as the cable 68 to which it is connected. This connection is shown in detail in FIG. 2 and is described in depth therewith.

The plurality of cable connector members 80 secures the cables 68 to the three-piece frame 36 and the planar surface 12*a*. The variety of connector members 80 utilized in the preferred embodiment comprises: one-pronged cable connector members 80*a*; two-pronged cable connector members 80*b*; and three-pronged cable connector members 80*c*. The number of prongs 78 of the connector members 80 may be varied depending on the needs of the user, as is known in the art. Each connector member 80 is attached to either the planar surface 12*a* or the three-piece frame 36 by screwing bolts therethrough. The novel positioning of the connector members 80 allows the furniture apparatus 10 to maintain its stationary state and stability.

FIG. 1 shows the preferred positioning of the connector members 80 when used in conjunction with the optimal number of ten cables 68 for maintaining the furniture apparatus 10 in a stationary position. In particular, a pair of two-pronged cable connector members 80*b* are symmetrically positioned at the opposing left and right side edges 26*b*, 26*d* of the planar surface 12*a* proximate to the midpoint of the rear portion 20 thereof. This connector member 80*b* has a top prong 78*a* and a bottom prong 78*b*. Another pair of two-pronged connector members 80*b* are symmetrically secured at the opposing left 50 and right 48 sides of the vertical column 38 near its top edge 44. The last pair of two-pronged connector members 80*b* are symmetrically positioned at the opposing left 64 and right 66 (shown in FIG. 4) sides of the horizontal bar 42 proximate to its front end 60. A pair of one-pronged connector members 80*a* are symmetrically secured at the opposing left 64 and right 66 (shown in FIG. 4) sides of the horizontal bar 42 proximate to its back end 62. Lastly, a pair of three-pronged connector members 80*c* are symmetrically positioned at the opposing left 28*c* and right 28*d* rear corners of the planar surface 12*a*. Each three-pronged connector member 80*c* has one top prong 78*a* and two bottom prongs 78*b*.

The cables 68 are secured to the connector members 80 and the turnbuckles 72 based on the above-described positioning of the connector members 80. As such, a first pair of cables 68*a* is symmetrically secured from each turnbuckle 72 attached to the top prongs 78*a* of the left and right side two-pronged connector members 80*b* of the planar surface 12*a* to one of the prongs of each of the respective left and right side two-pronged connector members 80*b* on the vertical column 38. A second pair of cables 68*b* is symmetrically secured from each turnbuckle 72 attached to the bottom prongs 78*b* of the left and right side two-pronged connector members 80*b* of the planar surface 12*a* to one of the prongs of each of the respective left and right side two-pronged connector members 80*b* located proximate to the front end 60 of the horizontal bar 42. A third pair of cables 68*c* is symmetrically secured from the remaining prong of the left and right side two-pronged connector members 80*b* on the vertical column 38 to the turnbuckles 72 attached to the top prongs of the three-pronged connector members 80*c* positioned at the respective left 28*c* and right 28*d* rear corners of the planar surface 12*a*. A fourth pair of cables 68*d* is symmetrically secured from the turnbuckles 72 attached to one of the bottom prongs 78 of the three-pronged connector members 80*c* positioned at the left and right rear corners 28*c*, 28*d* of the planar surface 12*a* to the remaining prong of each of the respective left and right side two-pronged connector members 80*b* located proximate to the front end 60 of the horizontal bar 42. A fifth pair of cables 68*e* is symmetrically secured from the turnbuckles 72 attached to the remaining bottom prongs 78 of each of the three-pronged connector members 80*c* positioned at the left and right rear corners 28*c*, 28*d* of the planar surface 12*a* to the prongs of the respective left and right side one-pronged connector members 68*a* located proximate to the back and 62 of the horizontal bar 42. In this most preferred embodiment, the planar surface 12*a* is not movable in any direction, thus being very stable in its stationary position. While the location of the fixed points 30,32 above and below the planar surface 12*a* are shown in a preferred embodiment in FIG. 1, it is to be understood that variations in the location of the fixed points 31,32 are also embodied by the disclosure herein so long as the planar surface 12*a* is maintained in a stationary position when in use.

Figure 2:
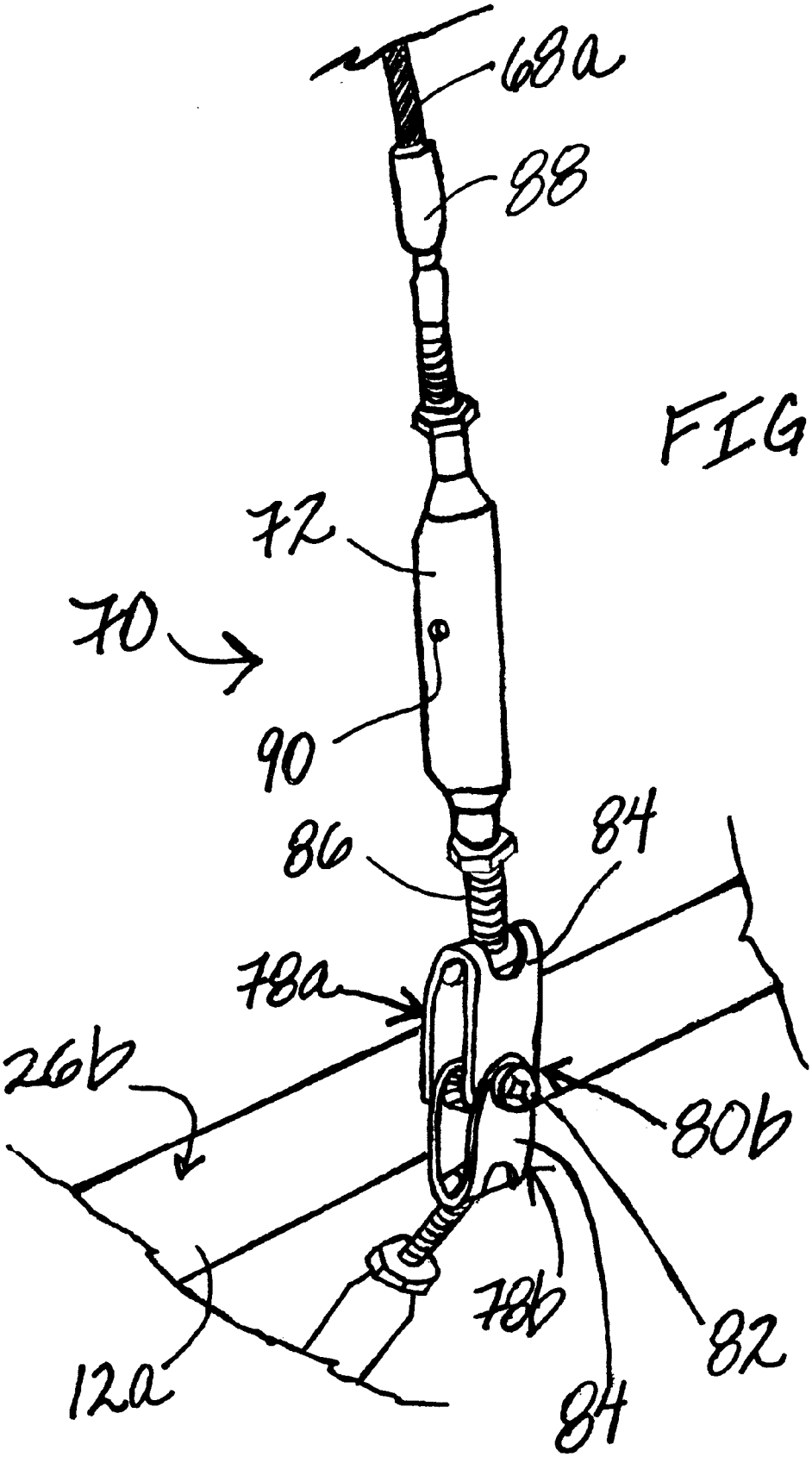
FIG. 2 illustrates an enlarged perspective view of the connection between the preferred tensioning means 70 and the suspending means 14 as both parts are secured to the left side edge 26*b* of the preferred planar surface 12*a*.

Referring to FIG. 2, the preferred tensioning means 70 of a turnbuckle 72 is shown in an enlarged perspective view as it is attached to the left side edge 26*b* of the planar surface 12*a*. A two-pronged cable connector member 80*b* is secured to the side edge 26*b* of the planar surface 12*a* using a bolt 82 inserted therethrough. The two-pronged 80*b* and three-pronged 80*c* connector members secured to the opposing side edges 26*b*, 26*d* and to the rear corners 28*c*, 28*d*, respectively, of the planar surface 12*a* are preferably separate jaw members 84, labeled above as individual prongs 78*a*, 78*b*. Each jaw member 84 is secured to each other and to the planar surface 12*a* by insertion of the bolts 82. A toggle jaw 86 is used to secure each jaw member 84 to a one end of a turnbuckle 70. The other end of the turnbuckle 70 is secured to a swage stud 88 that is swaged to one end of a cable 68*a*. As stated above, the swaging technique that secures the cable 68*c* to the swage stud 88 produces a connection that is just as strong as the cable 68*c*. Turning the turnbuckle 72 in a direction, either clockwise or counter-clockwise, perpendicular to its longitudinal axis adjusts the tension of the cable 68*a* secured thereto. The horizontal orifice 90 in the turnbuckle 72 allows for insertion of a sharp, small object, such as a pin or needle, to adjust the tension of the turnbuckle 72. The preferred swage stud 88, turnbuckle 70, toggle jaw 86, and jaw member 84 assembly is made by Johnson Marine under the tradename "STAINLESS STEEL TUBULAR TURNBUCKLES—JAW AND SWAGE."

FIG. 3 shows a side view of the suspended furniture apparatus 10 with the same preferred embodiment as shown in FIG. 1. The length 52 of the vertical column 38 is illustrated using dotted-lines extending from its top edge 44 to its bottom edge 46. The placement of the horizontal beam 40 in a parallel manner with the back side edge 26*c* of the planar surface 12*a* is apparent from the side view of the furniture apparatus 10 shown in FIG. 3. Also shown are the plurality of levelers or cushions members 92 that may optionally be used to prevent abrasion to both the beam 40 and the bar 42 and to the floor (not shown).

Referring to FIG. 4, a frontal view of the novel suspended furniture apparatus 10 is illustrated in the most preferred embodiment, shown previously in FIGS. 1 and 3. The advantageous symmetry of the attached cables 68 is visible from this angle. Additionally, the right sides 48,66 of the column 38 and the bar 42, respectively, are visible from this angle. The bolt 82 used to secure the connector members 80 to the frame 36 and the planar surface 12*a* (shown in FIG. 2) are also visible.

FIG. 5 shows another embodiment of the instant invention with the addition of a substantially planar backrest portion 16 and the use of eight cables 68 rather than ten cables 68. The backrest portion 16 has front 94 and back 96 (shown in FIG. 6) sides, top 98 and bottom 100 edges, and left 102 and right 104 edges. The backrest portion 16 shown in FIG. 5 has a quadrilateral shape and is positioned vertically above the rear edge 26*c* of the planar surface 12*a*. The shape of the backrest portion 16 may also comprise any other shape, such as circular, triangular, etc. However, a rectangular-shaped (FIGS. 5–6) and a trapezoidal-shaped (FIGS. 7–8) backrest portion 16 ate the preferred shapes. The backrest portion 16 is preferably positioned at an oblique angle A (shown in FIGS. 6 and 8) to the horizontal planar surface 12*a*, so that a person sitting on the planar surface 12*a* may lean comfortably on the front side 94 of the backrest portion 16. It is most preferred that the backrest portion 16 be positioned at an obtuse angle A to the planar surface 12*a*. The backrest portion 16 is maintained in a stationary position by being secured to a pair of cables 68*a*. To secure the backrest portion 16 to the cables 68*a*, two symmetrical vertical slits 106 are cut on the front side 94 of the backrest portion 16 for secure insertion of cables 68*a* therein. The slits 106 run from the top edge 98 to the bottom edge 100 of the backrest portion 16 and are angled away from each other from the top edge 98 to the bottom edge 100 to accommodate the angle of the cables 68*a*. Once the cables 68*a* are secured in the slits 106, four tack members 108 positioned proximate to the four corners 110*a*–110*d* of the front side 94 of the backrest portion 16 are attached thereto. The tack members 108 may be secured to the backrest portion 16 by insertion from its front side 94 through to its back side 96 (shown in FIG. 6) where a screw 112 (not shown) may be secured through the tack members 108 on the back side 96 of the backrest portion 16.

Still referring to FIG. 5, the securement of four pairs of cables 68*a*, 68*c*–68*e* to the frame 36 and the planar surface 12*a* is similar to the disclosure of FIGS. 1,3–4. However, one less pair of cables (shown in FIGS. 1,3–4 as 68*b*) is utilized. This results in the attachment of one-pronged connector members 80*a* symmetrically to each side edge 26*b*, 26*d* of the planar surface 12*a* and to each side 64,66 of the front end 60 of the horizontal bar 42, instead of using two-pronged connector members 80*b*. The use of one less pair of cables 68 allows the front edge 26*a* of the planar surface 12*a* to be lifted vertically upward, with the two rear corner three-pronged connector members 80*c* being the symmetrical pivot points. This lifting action is an option that some users may favor when storing the novel suspended furniture apparatus 10.

FIG. 6 shows a side view of the same embodiment of the novel furniture apparatus 10 as shown in FIG. 5. The back side 96 of the backrest portion 16 is visible from this view. In particular, the obtuse angle A of the backrest portion 16 relative to the planar surface 12*a* is now more apparent.

FIG. 7 illustrates a second embodiment of the backrest portion 16 in that it is trapezoidal-shaped. In contrast with the prior embodiment, the symmetrical slits 106 of the backrest portion 16 are cut from its top edge 98 to its bottom edge 100 at the left and right side edges 102,104 thereof. The tack members 108 are secured at the side edges 102,104 of the backrest portion 16 proximate to its corners 110*a*–110*d*. While a screw 112 (not shown) may be used in a similar manner as aforementioned to secure the tack member 108 to the edges 102,104 of the backrest portion 16, a second type of screw 114 may be inserted through the tack member 108 perpendicular to the side edges 102,104 of the backrest member 16 to contact the cables 68*a* secured in the slits 106. This will prevent either the cable 68*a* or the backrest portion 16 from moving vertically. Also shown in FIG. 7 is the use of five pairs of cables 68*a*–68*e*.

Additionally, FIG. 7 illustrates another embodiment of the fixed points above 30 and below 32 the horizontal planar surface 12. Generally, the at least one point 30 fixed above the planar surface 12 may be secured to either a ceiling surface C or a wall surface W (not shown), and the at least one point 32 fixed below the planar surface 12 may be secured to either a ground surface G or a wall surface W. The embodiment shown in FIG. 7 comprises one fixed point 30 secured to the ceiling surface C and two fixed points 32*a* and 32*b* secured to the ground surface G. The point 30 above the planar surface 12 should be located proximately above the rear edge 26*c* thereof. The forward point 32*a* below the planar surface 12 should be located proximately below the front edge 26*a* thereof, while the rearward point 32*b* below the planar surface 12 should be located proximately below the rear edge 26*c* thereof.

When this variation of fixed points 30,32*a* and 32*b* is utilized, they are secured to the respective ceiling C, wall W (shown in FIG. 8) or ground G surfaces using an anchor 122 (not shown) drilled into either the ceiling C, wall W or ground G surfaces. This anchor 122 will expand to create pressure that prevents the anchor 122 from disengaging from the ceiling C, wall W or ground G surface, as is known in the art. The most preferred anchors 122 are multi-set drop-in anchors 122*a* having a threaded cavity 124 (not shown). The threaded cavity 124 of each anchor 122 receives a threaded spade bolt 126. This spade bolt 126, as is known in the art, has an aperture 128 in its head portion 127 perpendicular to its longitudinal axis. A bolt 82 is inserted into the aperture 128 of the spade bolt 126 and, then, connector members 80 are secured to the bolt 82 in the manner described above. As described previously, cables 68 are attached to the connector members 80 to allow for suspension of the furniture apparatus 10.

A further variation in the use of the fixed points 30,32*a* and 32*b* secured to the respective ceiling C, wall W (shown in FIG. 8) or ground G surfaces is placing the tensioning means 70 near each fixed point 30,32 and inserting the cables 68 through holes 130 (not shown) drilled in the planar surface 12. When this embodiment is utilized, the end of each cable 68 proximate to the planar surface 12 has single shank balls 132 swaged thereto to secure the cable 68 to the planar surface 12. While this embodiment is not illustrated herein, one of skill in the art will appreciate this disclosure in comprehending the present invention.

FIG. 8 is a side view of the embodiment of the suspended furniture apparatus 10 disclosed in FIG. 7 with the exception that the rearward point 32*b* below the planar surface 12 is fixed to a wall surface W. One of skill in the art will know that the backrest portion 16 may be made of any of the substances used to make the planar surface 12, or substances similar thereto. Moreover, one of skill in the art would know that the planar surface 12 and the backrest portion 16 may comprise other quadrilateral shapes that would allow the novel suspended furniture apparatus 10 to maintain its intended utility.

FIG. 9 illustrates another embodiment of the fixed points 30,32 that suspend the novel furniture apparatus 10 in a stationary position. Only the fixed point 30 positioned above the planar surface 12*a* is shown, but one of skill in the art will understand that the following description applies to the fixed points 32 located below the planar surface 12*a* as well. In this embodiment, a horizontal orifice 116 takes the place of the cable connector members 80 as the fixed points 30,32. Specifically, one orifice 116 extends from the left side 50 to the right side 48 of the vertical column 38 proximate to its top edge 44. A second orifice 116 (not shown) extends from the left side 64 to the right side 66 of the horizontal bar 42 proximate to its front end 60. And a third orifice 116 (not shown) extends from the left side 64 to the right side 66 of the horizontal bar 42 proximate to its back end 60. When this embodiment is utilized, cables 68 are inserted through the orifices 116 so that each end of the cables 68 may be secured to either turnbuckles 72 or connector members 80. Thus, half the number of cables 68 are needed in this embodiment, compared with similar embodiments using connector members 80. Additionally, since only one turnbuckle 72 is needed per cable 68, half as many turnbuckles 72 are used in this embodiment. However, cables 68 inserted into the orifices 116 will likely crease, which decreases the strength of the cables 68. To prevent or decrease creasing, a crease preventing means 118 may be utilized. The crease preventing means 118 shown in FIG. 9 comprises a thimble 120 inserted into the orifice 116 to prevent the cables 68*a*, 68*c* from directly contacting the part of the column 38 that makes up the orifice 116. Likewise, thimbles 120 may be inserted into the orifices 32 positioned below the planar surface 12*a* to decrease creasing of the cables 68 inserted therein.

The foregoing discussion is illustrative of the invention. However, since many embodiments of the invention can be made without departing from the spirit and scope of the invention, the invention resides wholly in the claims hereinafter appended.

Hence, while the invention has been described in connection with a preferred embodiment, it will be understood that it is not intended that the invention be limited to that embodiment. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto; and (d) a three-piece frame, the frame comprising: a vertical column having a top and bottom edge, a left and right side, and two two-pronged cable connector members attached symmetrically to each of the left and right sides of the column proximate to the top edge thereof, the column having a length that extends above and below the planar surface, wherein the symmetrically attached two-pronged connector members comprise the point fixed above the planar surface; a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and a horizontal bar having a front and back end, a left and right side, and four one-pronged cable connector members attached thereto, the back end of the bar being secured to the midpoint of the frontal side of the beam in a perpendicular manner thereto, each of the four one-pronged cable connector members being symmetrically attached to the left and right sides of the bar proximate to its front and back ends, the bar lying on the ground surface in a perpendicular arrangement with the beam, wherein the symmetrically attached one-pronged connector members comprise the at least one point fixed below the planar surface, whereby the cables are secured to the plurality of prongs of the connector members to allow for suspension of the planar surface in a stationary position.

2. The suspended furniture apparatus of claim 1 wherein:

(a) the planar surface comprises a square-shaped planar surface having four corners and two one-pronged cable connector members at the opposing left and right side edges of the planar surface, wherein the one-pronged connector members are located proximate to a midpoint of the rear portion of the planar surface;

(b) the tensioning means comprises eight turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (c) the cables comprise a cable assembly having:

(i) a first pair of cables symmetrically secured from each turnbuckle attached to the prongs of the left and right side one-pronged connector members of the planar surface to one of the prongs of each of the respective left and right side two-pronged connector members on the vertical column;

(ii) two three-pronged cable connector members positioned at each of the rear left and rear right corners of the planar surface, the three-pronged connector members having a top prong and two bottom prongs, (iii) a second pair of cables symmetrically secured from the remaining prong of the left and right side two-pronged connector members on the vertical column to the turnbuckles attached to the top prongs of the three-pronged connector members positioned at the respective left and right rear corners of the planar surface;

(iv) a third pair of cables symmetrically secured from the turnbuckles attached to one of the bottom prongs of the three-pronged connector members positioned at the left and right rear corners of the planar surface to the prongs of the respective left and right side one-pronged connector members located proximate to the front end of the horizontal bar; and (v) a fourth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface in a stationary position.

3. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto; and (d) a three-piece frame, the frame comprising: vertical column having a top and bottom edge, a left and right side, and two two-pronged cable connector members attached symmetrically to each of the left and right sides of the column proximate to the top edge thereof, the column having a length that extends above and below the planar surface, wherein the symmetrically attached two-pronged connector members comprise the point fixed above the planar surface; a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and a horizontal bar having a front and back end, a left and right side, two one-pronged cable connector members and two two-pronged cable connector members attached thereto, the back end of the bar being secured to the midpoint of the frontal side of the beam in a perpendicular manner thereto, the two two-pronged cable connector members being symmetrically attached to the left and right sides of the bar proximate to its front end, the two one-pronged cable connector members being symmetrically attached to the left and right sides of the bar proximate to its back end, and the bar lying on the ground surface in a perpendicular arrangement with the beam, wherein the symmetrically attached one-pronged and two-pronged connector members comprise the at least one point fixed below the planar surface, whereby the cables are secured to the plurality of prongs of the connector members to allow for suspension of the planar surface in a stationary position.

4. The suspended furniture apparatus of claim 3 wherein:

(a) the planar surface comprises a square-shaped planar surface having four corners and two two-pronged cable connector members at the opposing left and right side edges of the planar surface, the two-pronged connector members having a top and bottom prong, wherein the two-pronged connector members are located proximate to a midpoint of the rear portion of the planar surface;

(b) the tensioning means comprises ten turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (c) the cables comprise a cable assembly having:

(i) a first pair of cables symmetrically secured from each turnbuckle attached to the top prongs of the left and right side two-pronged connector members of the planar surface to one of the prongs of each of the respective left and right side two-pronged connector members on the vertical column;

(ii) a second pair of cables symmetrically secured from each turnbuckle attached to the bottom prongs of the left and right side two-pronged connector members of the planar surface to one of the prongs of each of the respective left and right side two-pronged connector members located proximate to the front end of the horizontal bar;

(iii) two three-pronged cable connector members positioned at each of the rear left and rear right corners of the planar surface, the three-pronged connector members having a top prong and two bottom prongs, (iv) a third pair of cables symmetrically secured from the remaining prong of the left and right side two-pronged connector members on the vertical column to the turnbuckles attached to the top prongs of the three-pronged connector members positioned at the respective left and right rear corners of the planar surface;

(v) a fourth pair of cables symmetrically secured from the turnbuckles attached to one of the bottom prongs of the three-pronged connector members positioned at the left and right rear corners of the planar surface to the remaining prong of each of the respective left and right side two-pronged connector members located proximate to the front end of the horizontal bar; and (vi) a fifth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface in a stationary position.

5. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto; and (d) a three-piece frame, the frame comprising: a vertical column having a top and bottom edge, a left and right side, and a horizontal orifice near its top edge that extends from the left to the right side thereof, the column having a length that extends above and below the planar surface, wherein the orifice comprises the point fixed above the planar surface; a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and a horizontal bar having a front and back end, a left and right side, a horizontal orifice proximate to its front end and another horizontal orifice proximate to its back end, the two orifices of the bar extending from its left side to its right side, the back end of the bar being secured to the midpoint of the frontal side of the beam in a perpendicular manner thereto, the bar lying on the ground surface in a perpendicular arrangement with the beam, wherein the two orifices of the bar comprise the at least one point fixed below the planar surface, whereby the cables are secured to the orifices of the vertical column and the horizontal bar by insertion therethrough to allow for suspension of the planar surface in a stationary position.

6. The suspended furniture apparatus of claim 5 wherein:

(a) the planar surface comprises a square-shaped planar surface having four corners and two one-pronged cable connector members at the opposing side edges of the planar surface, wherein the one-pronged connector members are located proximate to a midpoint of the rear portion of the planar surface;

(b) the tensioning means comprises four turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (c) the cables comprise a cable assembly having:

(i) a first cable extending at one end thereof from the turnbuckle attached to the onepronged connector member at one side edge of the planar surface through the orifice near the top edge of the column to, at the other end of the first cable, the one-pronged connector member at the other side edge of the planar surface;

(ii) two three-pronged cable connector members positioned at each of the rear left and rear right corners of the planar surface, the three-pronged connector members having a top prong and two bottom prongs;

(iii) a second cable extending at one end thereof from the turnbuckle attached to the top prong of the three-pronged connector member positioned at the one rear corner of the planar surface through the orifice near the top edge of the vertical column to, at the other end of the second cable, the top prong of the three-pronged connector member positioned at the other rear corner of the planar surface;

(iv) a third cable extending at one end thereof from the turnbuckle attached to one of the bottom prongs of the three-pronged connector member positioned at one rear corner of the planar surface through the orifice proximate to the front end of the horizontal bar to, at the other end of the third cable, one of the bottom prongs of the three-pronged connector member positioned at the other rear corner of the planar surface; and (v) a fourth cable extending at one end thereof from the turnbuckle attached to the remaining bottom prong of the three-pronged connector member positioned at one rear corner of the planar surface through the orifice proximate to the back end of the horizontal bar to, at the other end of the fourth cable, the remaining bottom prong of the three-pronged connector member positioned at the other rear corner of the planar surface, whereby the cables are secured to the plurality of connector members and turnbuckles to allow for suspension of the planar surface in a stationary position.

7. The suspended furniture apparatus of claim 5 wherein:

(a) the planar surface comprises a square-shaped planar surface having four corners and two two-pronged cable connector members at the opposing side edges of the planar surface, the two-pronged connector members having a top prong and a bottom prong, wherein the two-pronged connector members are located proximate to a midpoint of the rear portion of the planar surface;

(b) the tensioning means comprises five turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (c) the cables comprise a cable assembly having:

(i) a first cable extending at one end thereof from the turnbuckle attached to the top prong of the two-pronged connector member at one side edge of the planar surface through the orifice near the top edge of the column to, at the other end of the first cable, the top prong of the two-pronged connector member at the other side edge of the planar surface;

(ii) a second cable extending at one end thereof from the turnbuckle attached to the bottom prong of the two-pronged connector member at one side edge of the planar surface through the orifice proximate to the front end of the horizontal bar to, at the other end of the second cable, the bottom prong of the two-pronged connector member at the other side edge of the planar surface;

(iii) two three-pronged cable connector members positioned at each of the rear left and rear right corners of the planar surface, the three-pronged connector members having a top prong and two bottom prongs;

(iv) a third cable extending at one end thereof from the turnbuckle attached to the top prong of the three-pronged connector member positioned at one rear corner of the planar surface through the orifice near the top edge of the vertical column to, at the other end of the third cable, the top prong of the three-pronged connector member positioned at the other rear corner of the planar surface;

(v) a fourth cable extending at one end thereof from the turnbuckle attached to one of the bottom prongs of the three-pronged connector member positioned at one rear corner of the planar surface through the orifice proximate to the front end of the horizontal bar to, at the other end of the fourth cable, one of the bottom prongs of the three-pronged connector member positioned at the other rear corner of the planar surface; and (vi) a fifth cable extending at one end thereof from the turnbuckle attached to the remaining bottom prong of the three-pronged connector member positioned at one rear corner of the planar surface through the orifice proximate to the back end of the horizontal bar to, at the other end of the fifth cable, the remaining bottom prong of the three-pronged connector member positioned at the other rear corner of the planar surface, whereby the cables are secured to the plurality of connector members and turnbuckles to allow for suspension of the planar surface in a stationary position.

8. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto;

(d) the at least one point fixed above the planar surface comprises a point fixed on a ceiling surface proximately above the rear edge of the planar surface; and (e) the at least one point fixed below the planar surface comprises:

(1) a forward point fixed on a ground surface proximately below the front edge of the planar surface; and (2) a rearward point fixed on the ground surface proximately below the rear edge of the planar surface, whereby the cables are secured to the fixed points.

9. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto;

(d) the at least one point fixed above the planar surface comprises a point fixed on a ceiling surface proximately above the rear edge of the planar surface; and (e) the at least one point fixed below the planar surface comprises:

(1) a forward point fixed on a ground surface proximately below the front edge of the planar surface; and (2) a rearward point fixed on a wall surface proximately below the rear edge of the planar surface, whereby the cables are secured to the fixed points.

10. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto;

(d) the at least one point fixed above the planar surface comprises a point fixed on a wall surface proximately above the rear edge of the planar surface; and (e) the at least one point fixed below the planar surface comprises:

(1) a forward point fixed on a ground surface proximately below the front edge of the planar surface; and (2) a rearward point fixed on the ground surface proximately below the rear edge of the planar surface, whereby the cables are secured to the fixed points.

11. A suspended furniture apparatus for use as a table or a chair, the furniture apparatus comprising:

(a) a generally horizontal and substantially planar surface having a front portion, a rear portion, a left side, a right side and edges thereabout;

(b) cables for suspending the planar surface in a stationary position, the cables being secured to the planar surface and fixed at at least one point above and at least one point below the planar surface;

(c) tensioning means for adjusting the tension of the cables and being secured thereto;

(d) the at least one point fixed above the planar surface comprises a point fixed on a wall surface proximately above the rear edge of the planar surface; and (e) the at least one point fixed below the planar surface comprises:

(1) a forward point fixed on a ground surface proximately below the front edge of the planar surface; and (2) a rearward point fixed on a wall surface proximately below the rear edge of the planar surface, whereby the cables are secured to the fixed points.

12. A suspended furniture apparatus for use as a table or a chair, the furniture apparatus comprising:

(a) a generally horizontal and substantially planar surface having a front portion, a rear portion, a left side, a right side and edges thereabout;

(b) a backrest portion having a front and back side, a top and bottom edge, and a left and right edge, the backrest portion being positioned vertically above the rear edge of the planar surface; and (c) non-rigid means for suspending the planar surface and the backrest portion in stationary positions, the suspending means being secured to both the planar surface and the backrest portion, the suspending means further being fixed at at least one point above and at least one point below the planar surface.

13. The suspended furniture apparatus of claim 12 further comprising tensioning means for adjusting the tension of the suspending means and being secured thereto.

14. The suspended furniture apparatus of claim 13 wherein the suspending means comprises cables.

15. The suspended furniture apparatus of claim 14 further comprising a three-piece frame, the frame comprising:

(a) a vertical column having a top and bottom edge, a left and right side, and two two-pronged cable connector members attached symmetrically to each of the left and right sides of the column proximate to the top edge thereof, the column having a length that extends above the backrest portion and below the planar surface, wherein the symmetrically attached two-pronged connector members comprise the point fixed above the backrest portion;

(b) a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and (c) a horizontal bar having a front and back end, a left and right side, and four one-pronged cable connector members attached thereto, the back end of the bar being secured to the midpoint of the frontal side of the beam in a perpendicular manner thereto, each of the four one-pronged cable connector members being symmetrically attached to the left and right sides of the bar proximate to its front and back ends, the bar lying on the ground surface in a perpendicular arrangement with the beam, wherein the symmetrically attached one-pronged connector members comprise the at least one point fixed below the planar surface, whereby the cables are secured to the plurality of prongs of the connector members to allow for suspension of the planar surface and the backrest portion in stationary positions.

16. The suspended furniture apparatus of claim 14 further comprising a three-piece frame, the frame comprising:

(a) a vertical column having a top and bottom edge, a left and right side, and two two-pronged cable connector members attached symmetrically to each of the left and right sides of the column proximate to the top edge thereof, the column having a length that extends above the backrest portion and below the planar surface, wherein the symmetrically attached two-pronged connector members comprise the point fixed above the backrest portion;

(b) a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and (c) a horizontal bar having a front and back end, a left and right side, two one-pronged cable connector members and two two-pronged cable connector members attached thereto, the back end of the bar being secured to the midpoint of the frontal side of the beam in a perpendicular manner thereto, the two two-pronged cable connector members being symmetrically attached to the left and right sides of the bar proximate to its front end, and the two one-pronged cable connector members being symmetrically attached to the left and right sides of the bar proximate to its back end, the bar lying on the ground surface in a perpendicular arrangement with the beam, wherein the symmetrically attached one-pronged and two-pronged connector members comprise the at least one point fixed below the planar surface, whereby the cables are secured to the plurality of prongs of the connector members to allow for suspension of the planar surface and the backrest portion in stationary positions.

17. The suspended furniture apparatus of claim 16 wherein:

(a) the planar surface comprises a square-shaped planar surface having four corners and two two-pronged cable connector members at the opposing left and right side edges of the planar surface, the two-pronged connector members having a top and bottom prong, wherein the two-pronged connector members are located proximate to a midpoint of the rear portion of the planar surface;

(b) the backrest portion comprises a quadrilateral-shaped backrest portion having four corners and two symmetrical vertical slits running along the front side of the backrest portion from its top edge to its bottom edge, the slits being angled obliquely outwardly from the top edge to the bottom edge to allow for insertion of cables therein;

(c) four tack members for securing the cables inserted within the two slits of the backrest portion, each tack member being attached to the front side of the backrest portion proximate to each of its four corners;

(d) the tensioning means comprises ten turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (e) the cables comprise a cable assembly having:

(i) a first pair of cables symmetrically secured from each turnbuckle attached to the top prongs of the left and right side two-pronged connector members of the planar surface to one of the prongs of each of the respective left and right side two-pronged connector members on the vertical column, wherein the first pair of cables is secured within the two slits of the backrest portion;

(ii) a second pair of cables symmetrically secured from each turnbuckle attached to the bottom prongs of the left and right side two-pronged connector members of the planar surface to one of the prongs of each of the respective left and right side two-pronged connector members located proximate to the front end of the horizontal bar;

(iii) two three-pronged cable connector members positioned at each of the rear left and rear right corners of the planar surface, the three-pronged connector members having a top prong and two bottom prongs, (iv) a third pair of cables symmetrically secured from the remaining prong of the left and right side two-pronged connector members on the vertical column to the turnbuckles attached to the top prongs of the three-pronged connector members positioned at the respective left and right rear corners of the planar surface;

(v) a fourth pair of cables symmetrically secured from the turnbuckles attached to one of the bottom prongs of the three-pronged connector members positioned at the left and right rear corners of the planar surface to the remaining prong of each of the respective left and right side two-pronged connector members located proximate to the front end of the horizontal bar; and (vi) a fifth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface and the backrest portion in stationary positions.

18. The suspended furniture apparatus of claim 14 further comprising a three-piece frame, the frame comprising:

(a) a vertical column having a top and bottom edge, a left and right side, and a horizontal orifice near its top edge that extends from the left to the right side thereof, the column having a length that extends above the backrest portion and below the planar surface, wherein the orifice comprises the point fixed above the backrest portion;

(b) a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and (c) a horizontal bar having a front and back end, a left and right side, a horizontal orifice proximate to its front end and another horizontal orifice proximate to its back end, the two orifices of the bar extending from its left side to its right side, the back end of the bar being secured to the midpoint of the frontal side of the beam in a perpendicular manner thereto, the bar lying on the ground surface in a perpendicular arrangement with the beam, wherein the two orifices of the bar comprise the at least one point fixed below the planar surface, whereby the cables are secured to the orifices of the vertical column and the horizontal bar by insertion therethrough to allow for suspension of the planar surface and the backrest portion in stationary positions.

19. The suspended furniture apparatus of claim 18 wherein:

(a) the planar surface comprises a square-shaped planar surface having four corners and two one-pronged cable connector members at the opposing side edges of the planar surface, wherein the one-pronged connector members are located proximate to a midpoint of the rear portion of the planar surface;

(b) the backrest portion comprises a quadrilateral-shaped backrest portion having four corners and two symmetrical vertical slits running along the front side of the backrest portion from its top edge to its bottom edge, the slits being angled obliquely outwardly from the top edge to the bottom edge to allow for insertion of cables therein;

(c) four tack members for securing the cables inserted within the two slits of the backrest portion, each tack member being attached to the front side of the backrest portion proximate to each of its four corners;

(d) the tensioning means comprises four turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (e) the cables comprise a cable assembly having:

(i) a first cable extending at one end thereof from the turnbuckle attached to the one-pronged connector member at one side edge of the planar surface through the orifice near the top edge of the column to, at the other end of the first cable, the one-pronged connector member at the other side edge of the planar surface, wherein the first cable is secured within the two slits of the backrest portion;

(ii) two three-pronged cable connector members positioned at each of the rear left and rear right corners of the planar surface, the three-pronged connector members having a top prong and two bottom prongs;

(iii) a second cable extending at one end thereof from the turnbuckle attached to the top prong of the three-pronged connector member positioned at one rear corner of the planar surface through the orifice near the top edge of the vertical column to, at the other end of the second cable, the top prong of the three-pronged connector member positioned at the other rear corner of the planar surface;

(iv) a third cable extending at one end thereof from the turnbuckle attached to one of the bottom prongs of the three-pronged connector member positioned at one rear corner of the planar surface through the orifice proximate to the front end of the horizontal bar to, at the other end of the third cable, one of the bottom prongs of the three-pronged connector member positioned at the other rear corner of the planar surface; and (v) a fourth cable extending at one end thereof from the turnbuckle attached to the remaining bottom prong of the three-pronged connector member positioned at one rear corner of the planar surface through the orifice proximate to the back end of the horizontal bar to, at the other end of the fourth cable, the remaining bottom prong of the three-pronged connector member positioned at the other rear right corner of the planar surface, whereby the cables are secured to the plurality of connector members and turnbuckles to allow for suspension of the planar surface and the backrest portion in stationary positions.

20. The suspended furniture apparatus of claim 18 wherein:

(a) the planar surface comprises a square-shaped planar surface having four corners and two two-pronged cable connector members at the opposing side edges of the planar surface, the two-pronged connector members having a top prong and a bottom prong, wherein the two-pronged connector members are located proximate to a midpoint of the rear portion of the planar surface;

(b) the backrest portion comprises a quadrilateral-shaped backrest portion having four corners and two symmetrical vertical slits running along the front side of the backrest portion from its top edge to its bottom edge, the slits being angled obliquely outwardly from the top edge to the bottom edge to allow for insertion of cables therein;

(c) four tack members for securing the cables inserted within the two slits of the backrest portion, each tack member being attached to the front side of the backrest portion proximate to each of its four corners;

(d) the tensioning means comprises five turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (e) the cables comprise a cable assembly having:

(i) a first cable extending at one end thereof from the turnbuckle attached to the top prong of the two-pronged connector member at one side edge of the planar surface through the orifice near the top edge of the column to, at the other end of the first cable, the top prong of the two-pronged connector member at the other side edge of the planar surface, wherein the first cable is secured within the two slits of the backrest portion;

(ii) a second cable extending at one end thereof from the turnbuckle attached to the bottom prong of the two-pronged connector member at one side edge of the planar surface through the orifice proximate to the front end of the horizontal bar to, at the other end of the second cable, the bottom prong of the two-pronged connector member at the other side edge of the planar surface;

(iii) two three-pronged cable connector members positioned at each of the rear left and rear right corners of the planar surface, the three-pronged connector members having a top prong and two bottom prongs;

(iv) a third cable extending at one end thereof from the turnbuckle attached to the top prong of the three-pronged connector member positioned at one rear corner of the planar surface through the orifice near the top edge of the vertical column to, at the other end of the third cable, the top prong of the three-pronged connector member positioned at the other rear corner of the planar surface;

(v) a fourth cable extending at one end thereof from the turnbuckle attached to one of the bottom prongs of the three-pronged connector member positioned at one rear corner of the planar surface through the orifice proximate to the front end of the horizontal bar to, at the other end of the fourth cable, one of the bottom prongs of the three-pronged connector member positioned at the other rear corner of the planar surface; and (vi) a fifth cable extending at one end thereof from the turnbuckle attached to the remaining bottom prong of the three-pronged connector member positioned at one rear corner of the planar surface through the orifice proximate to the back end of the horizontal bar to, at the other end of the fifth cable, the remaining bottom prong of the three-pronged connector member positioned at the other rear corner of the planar surface, whereby the cables are secured to the plurality of connector members and turnbuckles to allow for suspension of the planar surface and the backrest portion in stationary positions.

21. The suspended furniture apparatus of claim 14 wherein:

(a) the at least one point fixed above the planar surface comprises a point fixed on a ceiling surface proximately above the rear edge of the planar surface; and (b) the at least one point fixed below the planar surface comprises:

(1) a forward point fixed on a ground surface proximately below the front edge of the planar surface; and (2) a rearward point fixed on the ground surface proximately below the rear edge of the planar surface, whereby the cables are secured to the fixed points.

22. The suspended furniture apparatus of claim 14 wherein:

(a) the at least one point fixed above the planar surface comprises a point fixed on a ceiling surface proximately above the rear edge of the planar surface; and (b) the at least one point fixed below the planar surface comprises:

(1) a forward point fixed on a ground surface proximately below the front edge of the planar surface; and (2) a rearward point fixed on a wall surface proximately below the rear edge of the planar surface, whereby the cables are secured to the fixed points.

23. The suspended furniture apparatus of claim 14 wherein:

(a) the at least one point fixed above the planar surface comprises a point fixed on a wall surface proximately above the rear edge of the planar surface; and (b) the at least one point fixed below the planar surface comprises:

(1) a forward point fixed on a ground surface proximately below the front edge of the planar surface; and (2) a rearward point fixed on the ground surface proximately below the rear edge of the planar surface, whereby the cables are secured to the fixed points.

24. The suspended furniture apparatus of claim 14 wherein:

(a) the at least one point fixed above the planar surface comprises a point fixed on a wall surface proximately above the rear edge of the planar surface; and (b) the at least one point fixed below the planar surface comprises:

(1) a forward point fixed on a ground surface proximately below the front edge of the planar surface; and (2) a rearward point fixed on a wall surface proximately below the rear edge of the planar surface, whereby the cables are secured to the fixed points.

25. The suspended furniture apparatus of claim 13 wherein:

(a) the planar surface comprises a square-shaped planar surface having four corners and two one-pronged cable connector members at the opposing left and right side edges of the planar surface, wherein the one-pronged connector members are located proximate to a midpoint of the rear portion of the planar surface;

(b) the backrest portion comprises a quadrilateral-shaped backrest portion having four corners and two symmetrical vertical slits running along the front side of the backrest portion from its top edge to its bottom edge, the slits being angled obliquely outwardly from the top edge to the bottom edge to allow for insertion of cables therein;

(c) four tack members for securing the cables inserted within the two slits of the backrest portion, each tack member being attached to the front side of the backrest portion proximate to each of its four corners;

(d) the tensioning means comprises eight turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member; and (e) the cables comprise a cable assembly having:

(i) a first pair of cables symmetrically secured from each turnbuckle attached to the prongs of the left and right side one-pronged connector members of the planar surface to one of the prongs of each of the respective left and right side two-pronged connector members on the vertical column, wherein the first pair of cables is secured within the two slits of the backrest portion;

(ii) two three-pronged cable connector members positioned at each of the rear left and rear right corners of the planar surface, the three-pronged connector members having a top prong and two bottom prongs, (iii) a second pair of cables symmetrically secured from the remaining prong of the left and right side two-pronged connector members on the vertical column to the turnbuckles attached to the top prongs of the three-pronged connector members positioned at the respective left and right rear corners of the planar surface;

(iv) a third pair of cables symmetrically secured from the turnbuckles attached to one of the bottom prongs of the three-pronged connector members positioned at the left and right rear corners of the planar surface to the prongs of the respective left and right side one-pronged connector members located proximate to the front end of the horizontal bar; and (v) a fourth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface and the backrest portion in stationary positions.

26. A suspended furniture apparatus having a plurality of cables to suspend the furniture apparatus in a stationary position for use as a table or a chair, the furniture apparatus comprising:

(a) a square-shaped generally horizontal and substantially planar surface having front and rear portions, a left and right side, edges thereabout, and four corners, the planar surface further having two two-pronged cable connector members at the opposing left and right side edges thereof, the two-pronged connector members having a top and bottom prong, wherein the two-pronged connector members are located proximate to a midpoint of the rear portion of the planar surface;

(b) a three-piece frame comprising:

(i) a vertical column having a top and bottom edge, a left and right side, and two two-pronged cable connector member attached symmetrically to each of the left and right sides proximate to the top edge thereof, the column having a length that extends above and below the planar surface;

(ii) a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and (iii) a horizontal bar having a front and back end, a left and right side, and two one-pronged cable connector members and two two-pronged cable connector members attached thereto, the back end of the bar being secured to the midpoint of the frontal side of the beam in a perpendicular manner thereto, the two two-pronged connector members being symmetrically attached to the left and right sides of the bar proximate to its front end, the two one-pronged connector members being symmetrically attached to the left and right sides of the bar proximate to its back end, the bar lying on the ground surface in a perpendicular arrangement with the beam;

(c) ten turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member;

(d) a first pair of cables symmetrically secured from each turnbuckle attached to the top prongs of the left and right side two-pronged connector members of the planar surface to one of the prongs of each of the respective left and right side two-pronged connector members on the vertical column;

(e) a second pair of cables symmetrically secured from each turnbuckle attached to the bottom prongs of the left and right side two-pronged connector members of the planar surface to one of the prongs of each of the respective left and right side two-pronged connector members located proximate to the front end of the horizontal bar;

(f) two three-pronged cable connector members positioned at each of the rear left and rear right corners of the planar surface, the three-pronged connector members having a top prong and two bottom prongs, (g) a third pair of cables symmetrically secured from the remaining prong of the left and right side two-pronged connector members on the vertical column to the turnbuckles attached to the top prongs of the three-pronged connector members positioned at the respective left and right rear corners of the planar surface;

(h) a fourth pair of cables symmetrically secured from the turnbuckles attached to one of the bottom prongs of the three-pronged connector members positioned at the left and right rear corners of the planar surface to the remaining prong of each of the respective left and right side two-pronged connector members located proximate to the front end of the horizontal bar; and (i) a fifth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface in a stationary position.

27. A suspended furniture apparatus having a plurality of cables to suspend the furniture apparatus in a stationary position for use as a table or a chair, the furniture apparatus comprising:

(a) a square-shaped generally horizontal and substantially planar surface having front and rear portions, a left and right side, edges thereabout, and four corners, the planar surface further having two two-pronged cable connector members at the opposing left and right side edges thereof, the two-pronged connector members each having a top and bottom prong, wherein the two-pronged connector members are located proximate to a midpoint of the rear portion of the planar surface;

(b) a quadrilateral-shaped backrest portion having a front and back side, a top and bottom edge, a left and right edge, four corners, and two symmetrical vertical slits running along the front side of the backrest portion from its top edge to its bottom edge, the slits being angled obliquely outwardly from the top edge to the bottom edge to allow for insertion of cables therein, the backrest portion being positioned vertically above the rear edge of the planar surface at an acute angle thereto;

(c) four tack members for securing the cables inserted within the two slits of the backrest portion, each tack member being attached to the front side of the backrest portion proximate to each of its four corners;

(d) a three-piece frame comprising:

(i) a vertical column having a top and bottom edge, a left and right side, and two two-pronged cable connector members attached symmetrically to each of the left and right sides of the column proximate to the top edge thereof, the column having a length that extends above the backrest portion and below the planar surface;

(ii) a horizontal beam having a top edge, a frontal side and a midpoint, the beam lying on a ground surface in a parallel fashion to the rear edge of the planar surface, wherein the bottom edge of the column is secured on the midpoint of the top edge of the beam in a perpendicular manner thereto; and (iii) a horizontal bar having a front and back end, a left and right side, two one-pronged cable connector members and two two-pronged cable connector members attached thereto, the back end of the bar being secured to the midpoint of the frontal side of the beam in a perpendicular manner thereto, the two two-pronged cable connector members being symmetrically attached to the left and right sides of the bar proximate to its front end, the two one-pronged cable connector members being symmetrically attached to the left and right sides of the bar proximate to its back end, the bar lying on the ground surface in a perpendicular arrangement with the beam, (e) ten turnbuckles having opposing longitudinal ends, each turnbuckle being rotatable perpendicular to its longitudinal axis for adjusting the tension of the cable secured thereto, wherein one end of each turnbuckle is attached to a cable and the opposing end of each turnbuckle is attached to one prong of a cable connector member;

(f) a first pair of cables symmetrically secured from each turnbuckle attached to the top prongs of the left and right side two-pronged connector members of the planar surface to one of the prongs of each of the respective left and right side two-pronged connector members on the vertical column, wherein the first pair of cables is secured within the two slits of the backrest portion;

(g) a second pair of cables symmetrically secured from each turnbuckle attached to the bottom prongs of the left and right side two-pronged connector members of the planar surface to one of the prongs of each of the respective left and right side two-pronged connector members located proximate to the front end of the horizontal bar;

(h) two three-pronged cable connector members positioned at each of the rear left and rear right corners of the planar surface, the three-pronged connector members having a top prong and two bottom prongs, (i) a third pair of cables symmetrically secured from the remaining prong of the left and right side two-pronged connector members on the vertical column to the turnbuckles attached to the top prongs of the three-pronged connector members positioned at the respective left and right rear corners of the planar surface;

(j) a fourth pair of cables symmetrically secured from the turnbuckles attached to one of the bottom prongs of the three-pronged connector members positioned at the left and right rear corners of the planar surface to the remaining prong of each of the respective left and right side two-pronged connector members located proximate to the front end of the horizontal bar; and (k) a fifth pair of cables symmetrically secured from the turnbuckles attached to the remaining bottom prongs of each of the three-pronged connector members positioned at the left and right rear corners of the planar surface to the prongs of the respective left and right side one-pronged connector members located proximate to the back end of the horizontal bar, whereby the cables are secured to the plurality of connector members and turnbuckles to allow for suspension of the planar surface and the backrest portion in stationary positions.

* * * * *